US008978431B1

(12) United States Patent
Kernosky et al.

(10) Patent No.: US 8,978,431 B1
(45) Date of Patent: Mar. 17, 2015

(54) PUNCH AND METHOD FOR PIERCING HOLES WITH A RETENTION STRUCTURE

(71) Applicant: Ford Global Technologies, LLC, Dearborn, MI (US)

(72) Inventors: Stephen Kernosky, Livonia, MI (US); Kiran Kumar Mallela, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/135,645

(22) Filed: Dec. 20, 2013

(51) Int. Cl.

| | |
|---|---|
| ***B21D 31/02*** | (2006.01) |
| ***B21D 26/02*** | (2011.01) |
| ***B21D 28/28*** | (2006.01) |
| ***B21D 35/00*** | (2006.01) |
| ***B21D 26/033*** | (2011.01) |
| ***B26F 1/14*** | (2006.01) |

(52) U.S. Cl.
CPC ..... *B21D 35/001* (2013.01); *B21D 26/033* (2013.01); *B26F 1/14* (2013.01)
USPC ..... 72/55; 72/325; 72/326; 72/370.27; 29/896.6; 83/686

(58) Field of Classification Search
USPC ..... 72/55, 327, 370.27, 479, 326, 332, 333, 72/335, 464; 29/896.6; 83/686
See application file for complete search history.

(56) References Cited

U.S. PATENT DOCUMENTS

| | | | | |
|---|---|---|---|---|
| 161,968 | A * | 4/1875 | Kennedy | 83/689 |
| 4,739,687 | A * | 4/1988 | Wanner et al. | 83/688 |
| 6,109,086 | A * | 8/2000 | Gambrel et al. | 72/326 |
| 6,305,201 | B1 * | 10/2001 | Ghiran et al. | 72/55 |
| 6,658,908 | B1 * | 12/2003 | Ghiran et al. | 72/55 |
| 6,973,729 | B2 * | 12/2005 | Nordlin | 30/360 |
| 7,204,113 | B1 * | 4/2007 | Ghiran et al. | 72/55 |
| 7,249,480 | B2 | 7/2007 | Ghiran et al. | |
| 7,441,433 | B2 * | 10/2008 | Ghiran et al. | 72/71 |
| 7,484,397 | B2 * | 2/2009 | Coelho et al. | 72/325 |
| 7,503,198 | B1 | 3/2009 | Ghiran et al. | |
| 2007/0193323 | A1 * | 8/2007 | Coelho et al. | 72/55 |

OTHER PUBLICATIONS

The Fabricator.Com, Tube Hydroforming Design Flexibility—Part VII: Holes, Feb. 8, 2005.

* cited by examiner

*Primary Examiner* — David B Jones
(74) *Attorney, Agent, or Firm* — Damian Porcari; Brooks Kushman P.C.

(57) ABSTRACT

A punch including a shearing edge formed on an outer periphery of the punch, a cutting edge formed on the distal end of the punch and at least two ramp surfaces provided between the shearing and cutting edges. Each of the ramp surfaces extend at an angle from the distal end to a recessed portion of the shearing edge. The shearing edge, cutting edge and ramp surfaces cooperate to partially form a hole in a part and retain a slug in the hole. A method of forming a hole and a slug control system for a hydro-piercing operation is disclosed.

15 Claims, 5 Drawing Sheets

PUNCH AND METHOD FOR PIERCING HOLES WITH A RETENTION STRUCTURE

TECHNICAL FIELD

This disclosure relates to an apparatus and method for punching holes in a hydro-formed part.

BACKGROUND

Holes are formed in tubular hydro-formed parts that may function, for example, as locator holes or for receiving fasteners.

Tubular parts may be hydro-formed in a die with a pressure medium, such as water, being injected inside a tubular blank to form the blank to a desired shape. The part may be pierced in the hydro-forming machine with a hydro-piercing tool.

A hydro-piercing tool includes a punch that is advanced to engage an outer surface of the part while the inner surface is supported by the pressure medium. Hydraulic cylinders are actuated to drive the punch through the part to form a hole. When the hole is formed a slug is removed from the part forming a hole.

Loose slugs created in the hydro-piercing process can create problems if not properly managed. Loose slugs can become trapped in the interior of the part and may cause a rattling noise. Loose slugs can damage the hydro-forming die if they are dislodged from the part and fall into the die.

Several systems have been developed in an effort to control slugs created in the hydro-piercing process. One proposal is to punch a slug leaving a short retaining tab attaching the slug to the part. The slug is then folded back on the tab into the interior of the part. This proposal may be acceptable for ductile steel materials, but is not suitable for other materials such as aluminum and high-strength steel. Folding the slug into the interior of the part on the tab when applied to aluminum may result in the slug being fractured from the part. In addition, edge cracks may tend to form on the part proximate the hole when the hole is formed.

Referring to FIGS. 1A and 1B, a specialized punch is proposed that has two recessed portions for forming tabs that hold the slug in place after punching the hole. This punch may be used for aluminum but undesirable distortion may occur proximate the hole. This punch may not be well suited for circular holes.

This disclosure is directed to solving the above problems and other problems as summarized below.

SUMMARY

The disclosure provides a punch method and system for controlling slugs formed during hydro-piercing hydro-formed parts.

According to one aspect of this disclosure, a punch for a hydro-forming tool is disclosed. The punch comprises a shearing edge formed on an outer periphery of the punch that is partially recessed from a distal end of the punch and a cutting edge formed at the distal end of the punch inboard of the shearing edge. The punch further comprises at least two ramp surfaces provided between the shearing edge and the cutting edge. Each of the ramp surfaces extend about a portion of a periphery of the punch and extend at an angle from the distal end to a recessed portion of the shearing edge.

According to an alternative embodiment of the punch, each of the at least two ramp surfaces may extend perpendicular to a longitudinal axis of the punch in a radial direction between the cutting edge and the shearing edge.

According to an alternative embodiment of the punch, the at least two ramp surfaces may include three ramp surfaces that extend at a first incline angle and then at a second incline angle. The three ramp surfaces may be spaced 120 degrees apart.

The distal end may have a central portion and at least two outer portions extending outwardly from the central portion to the periphery of the punch. The at least two outer portions may be disposed at diametrically opposed locations on the central portion and may include a cut-off face extending between the cutting edge disposed on the outer portion and the ramp surface proximate the recessed portion of the shearing edge. The central portion may be circular in shape or may be elongated in shape having two semi-circular ends that are connected by flat sides. In the elongated central portion configuration, the two outer portions may be disposed at the semi-circular ends.

According to another aspect of this disclosure a method is disclosed for forming a hole in a part. The method comprises punching the part with a punch that has a cutting edge for cutting a slug in the part. A portion of the part is sheared to form an outer periphery of the hole outboard of the slug. Punching and shearing the part creates arms that connect the slug to the outer periphery of the hole. The punch advancing into the part bends the arms into the part and holds the slug in a recessed location on the part.

The method may further include detaching the arms from the part to remove the slug from the part and produce a finished hole.

According to other aspects of the method, the slug may be sheared by a shearing edge formed on a periphery of the punch. The punch may further include at least two ramp surfaces formed between the shearing edge and the cutting edge. The ramp surfaces may extend about a portion of the periphery of the punch and extend at an angle from the distal end to a recessed portion of the shearing edge. The ramp surface may engage the arms to bend the arms into the part during the punching operation.

According to another aspect of this disclosure, a slug control system is disclosed for a hydro-formed part. The system comprises a hydro-forming tool for forming the hydro-formed part and a hydro-piercing punch operable to partially form a hole having a predetermined periphery in the part. The hydro-piercing punch advances into the part to form a slug having a first arm and a second arm connecting a central portion of the slug to the periphery of the hole. The punch advances into the part to cause the first and second arms to partially sever from the part. The arms wrap around the periphery of the hole. The arms also extend from the periphery of the hole to the central portion of the slug. The punch when fully advanced causes the central portion, the first arm and the second arm to be retained in a recessed position on the part.

A tool maybe used to remove the slug from the part to produce a finished hole.

The above aspects of this disclosure and other aspects are described in greater detail below with reference to the attached drawings.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1A:
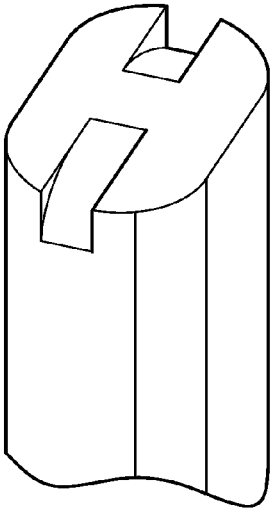
Fig-1A PRIOR ART
FIG. 1A is a perspective view of a prior art punch.
Figure 1B:
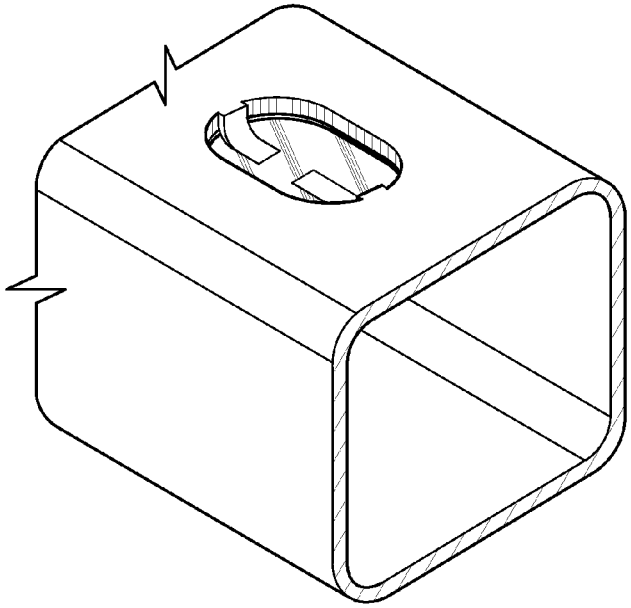
Fig-1B PRIOR ART
FIG. 1B is a perspective view of a part having a slug formed by the prior art punch of FIG. 1A.
Figure 2:
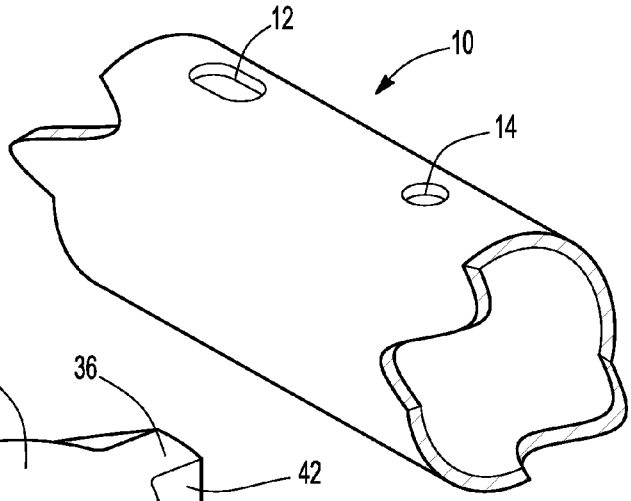
FIG. 2 is perspective view of a part having holes formed according to one exemplary embodiment of the present disclosure.

Referring to FIG. 2, a portion of a hydro-formed part 10 is shown with a two-way locator hole 12 and a four-way locater hole 14. The two-way locator hole 12 and four-way locator hole 14 are produced by the punch that is used in the disclosed method and system.

Figure 3:
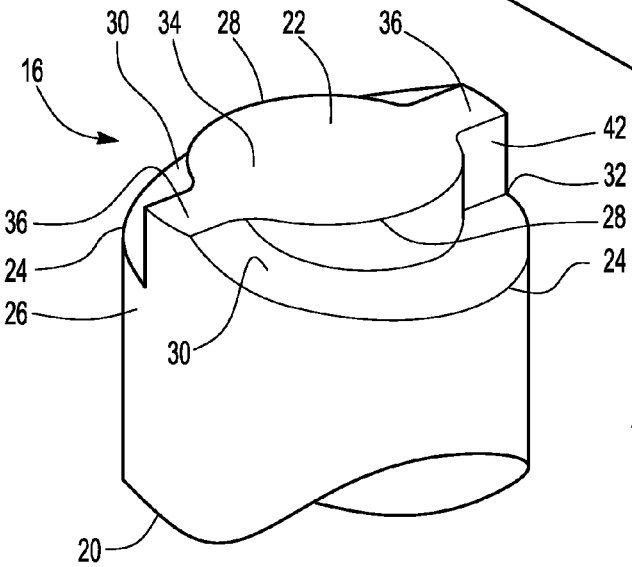
FIG. 3 is a perspective view of a circular punch made according to one embodiment of the present disclosure.

Referring to FIG. 3, one example of a punch 16 is shown for use with a hydro-forming tool. The punch 16 has a shank 20 attached to the hydro-forming tool (shown in FIG. 9) and a distal end or tip 22 that is first to engage the part 10 during the punching process. The punch 16 may be circular as shown in FIG. 3 or may be a different shape. The punch 16 has a shearing edge 24 formed on an outer periphery 26 of the punch 16. A cutting edge 28 is formed on the punch 16 inboard of the shearing edge 24 and is disposed on the distal end 22 of the punch 16. A ramp surface 30 is formed between the shearing edge 24 and the cutting edge 28. The ramp surface 30 extends about a portion of the periphery 26 and extends at an angle from the distal end 22 to a recessed portion 32 of the shearing edge 24.

The punch 16 includes two symmetrical ramp surfaces 30. Each of the two ramp surfaces 30 extends perpendicular to the longitudinal axis of the punch 16 in a radial direction to form a flat, angled surface that wraps around a portion of the periphery 26 of punch 16. The ramped surfaces 30 provide a gradual cut into the part 10 and reduce distortion of the part 10 around the hole being cut.

Figure 4:
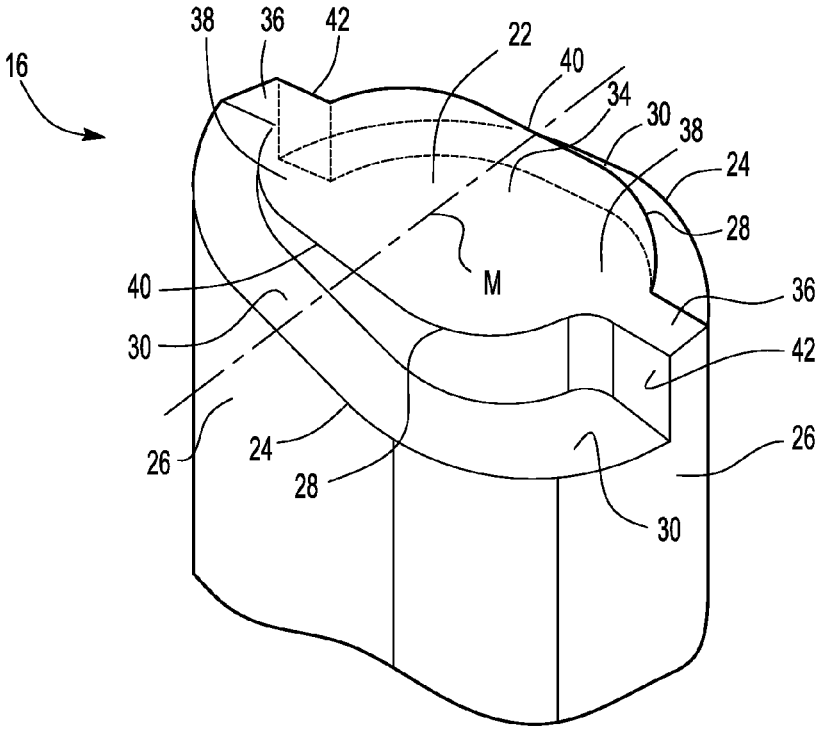
FIG. 4 is a perspective view of an oval punch made according to an alternative embodiment of the present disclosure.

The distal end 22 includes a central portion 34 and two diametrically opposed outer portions 36 extending outwardly from the central portion 34 to the periphery 26. The central portion 34 may be circular in shape as shown in FIG. 3 or may have an elongated shape as shown in FIG. 4. Each of the outer portions 36 includes a cut-off face 42 extending longitudinally between the cutting edge 28 disposed on the outer portion 36 and the recessed portion 32 of the shearing edge 24. The cut-off face 42 extends radially between the central portion 34 and the outer periphery 26.

FIG. 4 illustrates an oval punch having elongated central portion 34 and two semi-circular ends 38 that are symmetrical about the minor axis "M". Two flat sides 40 extend between and connect the semi-circular ends 38. Each of the outer portions 36 are disposed at the semi-circular ends 38 and extend radially between the ends 38 and the periphery 26 of the punch 16.

Figure 5:
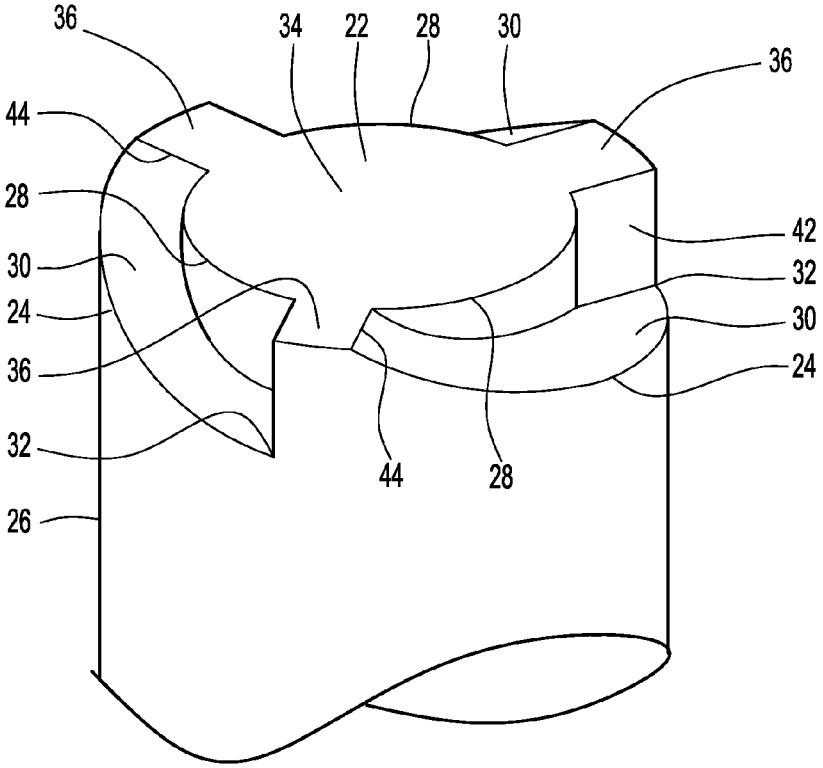
FIG. 5 is a perspective view of a circular punch made according to an alternative embodiment of the present disclosure that includes three ramp surfaces.

Referring to FIG. 5, an alternative design of punch 16 is shown. The distal end 22 of the punch 16 includes a circular central portion 34 with three outer portions 36 spaced 120 degrees apart. Three ramp surfaces 30 are formed on the punch 16 and extend between adjacent outer portions 36. Each of the ramp surfaces 30 are disposed radially between the center portion 34 and the outer periphery 26 and extend at an angle from a first edge 44 on the outer portion 36 to a cut-off face 42 formed on an adjacent outer portion 36.

Figure 6:
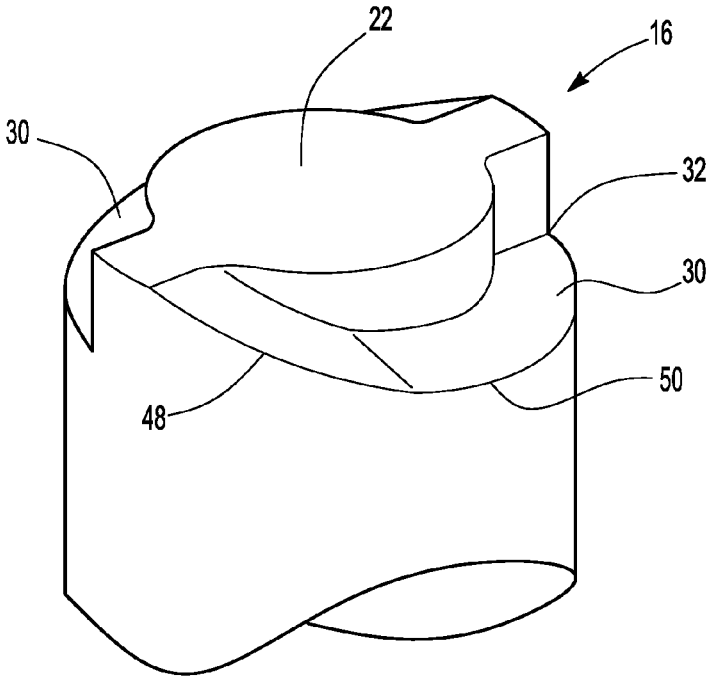
FIG. 6 is a perspective view of a circular punch made according to an alternative embodiment of the present disclosure that includes ramped surfaces that extend at two different inclined angles.
Figure 7:
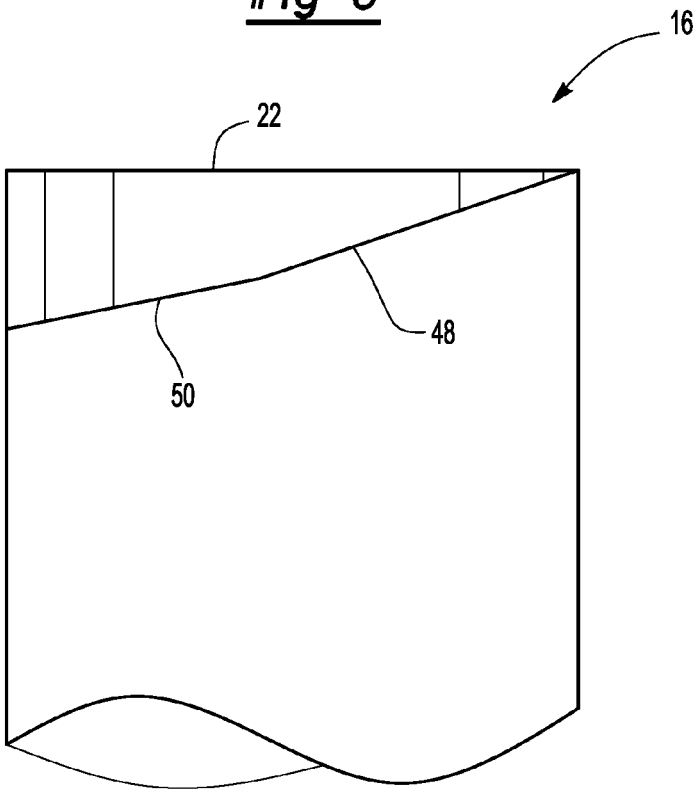
FIG. 7 is a side view of the punch shown in FIG. 6.

The ramp surface 30 may extend from the distal end 22 to a recessed portion 32 at a single linear angle, multiple linear angles, or along a continuously variable path. Changing the angle or angles of the ramp surface 30 allows the punch to be adapted for use with parts of different thicknesses. FIGS. 6 and 7 illustrate the multiple linear angles alternative. Each ramp surface 30 extends between the distal end 22 and the recessed portion 32 at a first angle 48 and then at a second angle 50. The multiple angle alternative is shown on a circular punch but it is equally applicable to non-circular punches.

Figure 8:
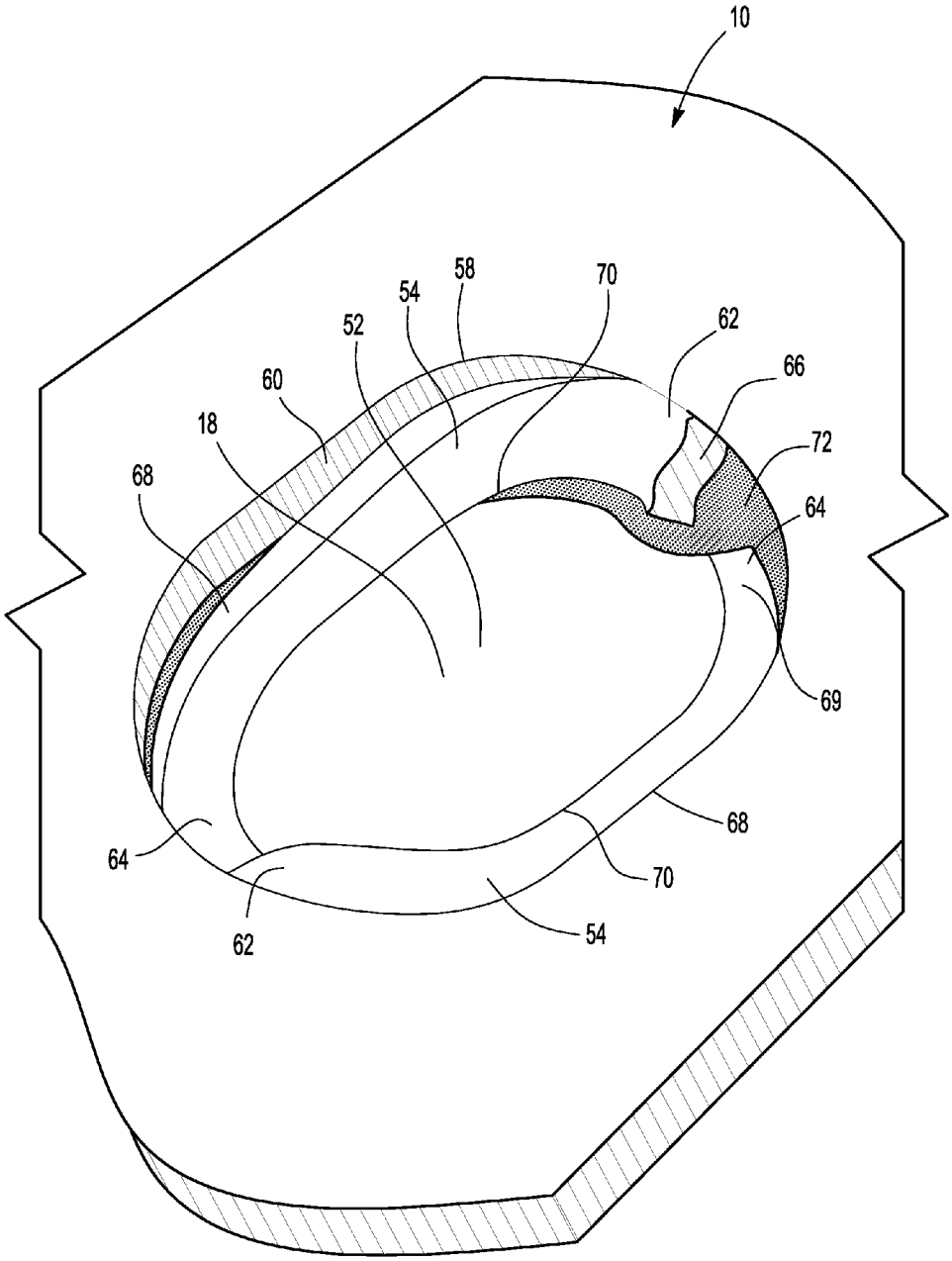
FIG. 8 is a perspective view of a slug formed in the part by the punch of FIG. 4.

Referring to FIG. 8, a part 10 post hydro-piercing is shown. The part 10 has a hole 60 and a slug 18 retained within the hole 60. The slug 18 has a recessed central portion 52 connected to first and second arms 54, both of which are connected to the part 10 at the periphery 58 of the hole 60 and retain the slug 18 on the part 10. Each of the arms 54 have a first end 62 connected to the hole periphery 58 and a second end 64 connected to the central portion 52. The first end 62 is completely detached from the central portion 52 and the second end 64 is completely detached from the part 10. The first end 62 includes an end-face 66 extending radially inward from an outer side 68 proximate the hole periphery 58 to an inner side 70 of the arm 54.

Referring to FIGS. 4 and 8, the punch 16 is driven into the part 10 partially forming the hole 60 and the slug 18. The punch 16 is initially advanced to cause the distal end 22 to first engage the part 10. The cutting edges 28 cut the part 10 to begin formation of the central portion 52, and the inner side 70 of the arms 54. The shearing edge 24 disposed at the periphery 26 of the outer portions 36 shear a portion of the part defining the periphery of the hole 60.

The shearing edge 24 disposed on the ramp surfaces 30 is advanced to shear the part 10 further cutting more of the periphery of the hole 60 and forming the outer-side 68 of the arms 54. The cutting edge 28 cuts the inner-side 70 to partially detach a portion of the arms 54 from the central portion 52. The ramp surfaces 30 bend the arms. The arms 54 are bent into the hole 60 as the inner side 70 and outer side 68 of the arms 54 are formed by the shearing and cutting edges of the punch 16. The arms 54 bend at an angle corresponding to the angle of the ramp surfaces 30 and have a similar shape. The cutting edge 28 disposed along the cut-off face 42 of the punch 16 cuts the end-face 66 of the slug 18 and creates a gap 72 between the first end 62 of the first arm 54 and the second end 64 of the second arm 54.

The central portion 34 of the punch 16 pushes the central portion 52 of the slug into a fully recessed position upon full advancement of the punch. The cutting edges 28 partially cut the inner side 70 of the arms 54 except at the second end 64 where the part 10 is not cut to ensure a strong connection between the arms 54 and the central portion 52. The shearing edge 24 has at least partially cut the hole 60 except at the first end 62 where the slug 18 is not cut to ensure a strong connection between the arms 54 and the part 10.

Figure 9:
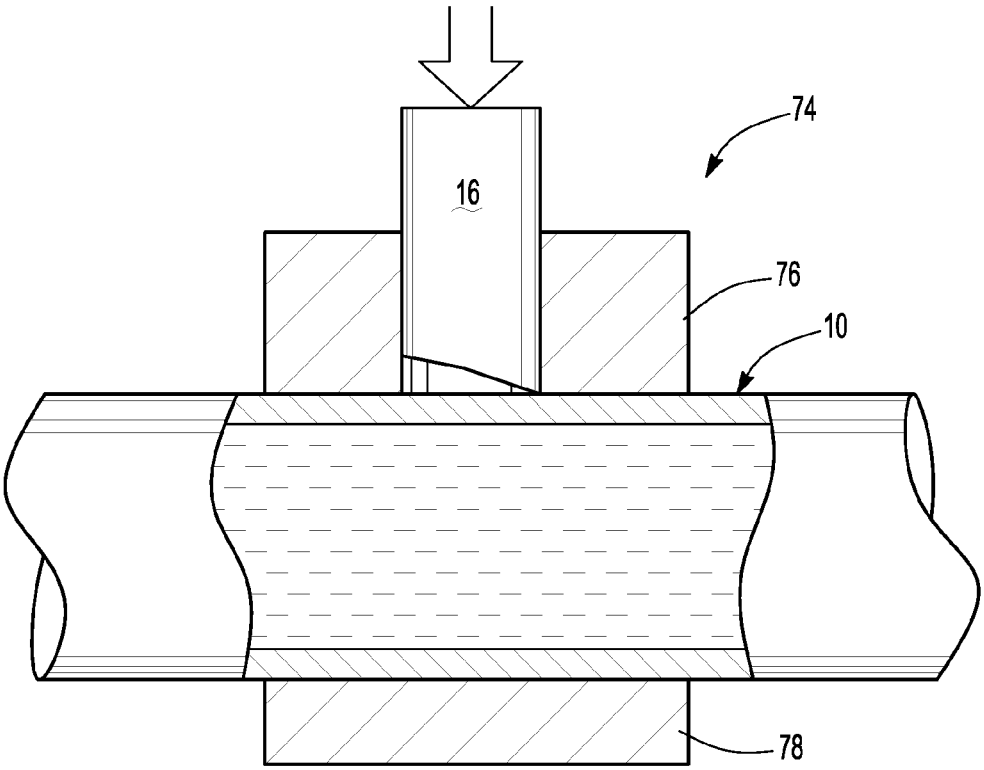
FIG. 9 is a diagrammatic cross-sectional view of a hydro-forming tool.

Referring to FIG. 9, a hydro-forming tool 74 is shown for use with the slug control system. The tool 74 includes a first die 76 and a second die 78. The tool 74 is opened and a part 10 is placed between the first die 76 and the second die 78. The tool 74 is closed and a fluid, such as water, is supplied under high pressure inside the part 10 to form the part 10 into the desired shape. After the part 10 is formed, the tool 74 actuates the hydro-piercing punch 16 to partially form the hole 60 with the slug 18 being retained inside the part 10. The part 10 is then removed from the tool 74. The slug 18 may then be removed by a manual tool or a robotic system.

While exemplary embodiments are described above, it is not intended that these embodiments describe all possible forms of the disclosure. The words used in the specification are words of description rather than limitation. Changes may be made to the illustrated embodiments without departing from the spirit and scope of the disclosure as claimed. The features of the illustrated embodiments may be combined to form further embodiments of the disclosed concepts.

What is claimed is:

1. A punch for a hydro-forming tool comprising:

a shearing edge formed on an outer periphery of the punch that is partially recessed from a distal end of the punch;

a cutting edge formed inboard of the shearing edge, wherein the cutting edge is disposed at the distal end of the punch; and at least two ramp surfaces provided between the shearing edge and the cutting edge, wherein each ramp surface extends about a portion of a periphery of the punch and extends at an angle from the distal end to a recessed portion of the shearing edge, wherein the distal end includes a central portion and at least two outer portions extending outwardly from the central portion to a periphery of the punch, each of the outer portions including a cut-off face extending between the cutting edge disposed on the outer portion and the ramp surface proximate the recessed portion of the shearing edge.

2. The punch of claim 1 wherein the central portion is circular.

3. The punch of claim 2 wherein the two outer portions are disposed at diametrically opposed locations on the central portion.

4. The punch of claim 1 wherein the central portion has two semi-circular ends that are connected by two flat sides.

5. The punch of claim 4 wherein the two outer portions are disposed at the semi-circular ends of the central portion.

6. The punch of claim 1 wherein each of the at least two ramp surfaces extend at a first incline angle and then at a second incline angle.

7. The punch of claim 1 wherein the at least two ramp surfaces include three ramp surfaces.

8. The punch of claim 1 wherein each of the at least two ramp surfaces extend perpendicular to a longitudinal axis of the punch in a radial direction between the cutting edge and the shearing edge.

9. A method of forming a hole comprising:

punching a part with a punch that has a cutting edge for cutting a slug;

shearing a portion of the part to form an outer periphery of the hole outboard of the slug, wherein arms are formed that connect the slug to the outer periphery of the hole; and bending the arms while shearing the part to hold the slug in a recessed location on the part.

10. The method of claim 9 further comprising:

detaching the arms from the part to remove the slug and arms from the part.

11. The method of claim 9 wherein the step of shearing a portion of the part is performed by a shearing edge formed on a periphery of the punch.

12. The method of claim 11 wherein the step of bending the arms further comprises engaging the arms with at least two ramp surfaces formed between the shearing edge and the cutting edge.

13. The method of claim 12 wherein the cutting edge is disposed at a distal end of the punch.

14. The method of claim 11 wherein the ramp surfaces extend about a portion of a periphery of the punch and extend at an angle from the distal end to a recessed portion of the shearing edge.

15. A slug control system for a hydro-formed part comprising:

a hydro-forming tool for forming the hydro-formed part;

a hydro-piercing punch operable to form a hole having a predetermined periphery in the part;

a slug formed in the part by the hydro-piercing punch, the slug having a first arm and a second arm connecting a central portion of the slug to the periphery of the hole, wherein the first and second arms are partially severed from the part and extend along the periphery of the hole, wherein the arms extend from the periphery of the hole to the central portion, and wherein the central portion, the first arm, and the second arm are retained in a recessed position on the part; and a tool configured to remove the slug from the part.

* * * * *